US006126439A

United States Patent [19]

Knöpfel et al.

[11] Patent Number: 6,126,439

[45] **Date of Patent: *Oct. 3, 2000**

[54] PREMIX BURNER

[75] Inventors: Hans Peter Knöpfel, Besenbüren; Giacomo Bolis, Zürich, both of Switzerland

[73] Assignee: ABB Alstom Power (Switzerland) Ltd, Baden, Switzerland

[ * ] Notice: This patent is subject to a terminal disclaimer.

[21] Appl. No.: 08/909,737

[22] Filed: Aug. 12, 1997

[30] Foreign Application Priority Data

Sep. 30, 1996 [DE] Germany ..... 196 40 198

[51] Int. Cl.[7] ..... F23M 9/00; F23C 5/00; F24D 5/00

[52] U.S. Cl. ..... 431/350; 431/9; 431/116; 431/351; 431/353; 431/354

[58] Field of Search ..... 431/8, 9, 10, 350, 431/357, 352, 353, 354, 181, 182, 187, 188, 159, 116, 115

[56] References Cited

U.S. PATENT DOCUMENTS

| | | | |
|---|---|---|---|
| 2,921,542 | 1/1960 | Kidwell et al. | 431/185 |
| 3,115,851 | 12/1963 | Ceely | 431/185 |
| 5,817,909 | 10/1998 | Lescuyer et al. | 431/10 |
| 5,876,196 | 3/1999 | Knopfel et al. | 431/183 |

FOREIGN PATENT DOCUMENTS

| | | | |
|---|---|---|---|
| 0321809B1 | 6/1989 | European Pat. Off. . | |
| 243407 | 12/1960 | Germany | 431/353 |
| 3464673 | of 1996 | Germany . | |
| 4435266A1 | 4/1996 | Germany . | |
| 784765 | 10/1957 | United Kingdom | 431/116 |
| WO93/17279 | 9/1993 | WIPO . | |

*Primary Examiner*—Can D. Price
*Attorney, Agent, or Firm*—Burns, Doane, Swecker & Mathis, L.L.P.

[57] ABSTRACT

In a premix burner, the swirl-stabilized interior space (18) has a conical inner body (13) running in the direction of flow. The outer casing of the interior space (18) is pierced by tangentially arranged air-inlet ducts **(11*a*, 12*a*) through which a combustion-air flow (16) flows into the interior space (18). The swirl flow (23) forming in the interior space (18) is enriched with a fuel via at least one fuel lance (17). The mixture of the two media is then formed in the downstream mixing tube (21). The mixing tube (21) then merges into a combustion space (31) via a jump in cross section, a backflow zone (32) forming in the region of the plane of the jump in cross section, which backflow zone (32)** ensures the stability of the combustion.

14 Claims, 2 Drawing Sheets

PREMIX BURNER

BACKGROUND OF THE INVENTION

1. Field of the Invention

The present invention relates to a premix burner.

2. Discussion of Background

Lean premixed combustion is a common method of achieving low pollutant emissions, in particular nitric-oxide emissions, in the combustion of fuels having a low content of nitric-oxide compounds. It has become known from publications that a further reduction in the nitric-oxide emissions, in particular during combustion at high pressure, as is the case in the modern generation of gas turbines, is possible with experimental burners by improving the mixture quality of air and fuel. However, applying such experimental burners to machine technology is not readily possible, since there are stringent requirements here with regard to flame stabilization and flashback safety. Conventional swirl-stabilized premix burners suitable for machines intermix the fuel with the combustion air only just before the flame zone.

Investigations in this connection have shown that homogeneous mixing of air and fuel up to the flame zone still cannot be achieved in this way. Shifting the fuel injection upstream to prolong the mixing time and thus improve the mixing quality is not permitted in a burner suitable for machines on account of the flashback risk associated therewith.

WO 93/17279 has disclosed a burner which essentially comprises a cylindrical chamber, which in turn has a plurality of tangentially arranged slots through which the combustion air flows into the interior of the chamber. In the region of these slots, at the transition to the interior space of the chamber, a number of fuel nozzles act in axial direction, through which preferably a gaseous fuel is admixed with the combustion air flowing through there. Furthermore, the interior space of the chamber is provided with a conical body, which tapers in the direction of flow, further fuel nozzles for a preferably liquid fuel being provided in the region of the tip of this conical body. The combustion air is made to ignite downstream of the cone tip of this body. In order to keep the flame stable outside the premix section of the burner, the flow in the chamber or premix section itself must be supercritical, i.e. the swirl coefficient must be so small here that no vortex breakdown occurs. The critical swirl coefficient can be achieved at the correct location by three paramaters: by a change in the width of the tangential slots, and on the other hand by an adaptation of the angle of the conical body in the interior space of the chamber, and also by the addition of central assisting air, whether swirled or without a swirl. Due to the fuel injection in the region of the slots, however, the latter are greatly restricted in their design. In addition, optimum homogeneous mixing of air and fuel cannot be achieved directly; this applies in particular to those fuel injections which are located at the end of the burner and which are therefore located directly in the region of the flame front, whereby there is also a potential flashback risk due to this proximity. Furthermore, both the gaseous fuel and the liquid fuel will not be readily mixed with the air due to the short distance from injection up to the flame, a factor which results in local rich zones in the flame, which lead to high NOx emissions and higher pulsations.

In summary, the following problems occur in such a burner:

a) increase in the risk of flashback of the flame, b) smaller operating range with optimum flame position, c) the NOx emissions increase, d) high pulsations, e) inadequate burn-out.

SUMMARY OF THE INVENTION

Accordingly, one object of the invention as defined in the claims, in a premix burner of the type mentioned at the beginning, is to remove the abovementioned disadvantages.

According to the invention, the configuration of the burner belonging to the prior art now performs the exclusive function of a swirl generator, a mixing tube being arranged downstream of this swirl generator. Only at the outlet of this mixing tube does the flame zone form.

The essential advantages of the invention may be seen in the fact that the flow at the outlet of the swirl generator is selected in such a way that no vortex breakdown occurs. The mixing tube arranged downstream of the swirl generator provides for the flame zone to be shifted further downstream and for better mixing of the air/fuel mixture. The vortex flow induced by the swirl generator then breaks down at the outlet of the mixing tube into the combustion chamber: a backflow bubble or backflow zone, which stabilizes the flame front, then forms there. In order to prevent flashback of the flame in the regions of the mixing tube which are near the wall (wall boundary layers), the mixing tube is provided with prefilming holes or slots which flush the boundary layer and also make it leaner. In the burner center, flashback of the flame is prevented by assisting air being injected centrally. This assisting air may be directed entirely axially or may be provided with a swirl.

An outlet radius having a breakaway edge, which outlet radius is made on the combustion-chamber side in the burner front, provides for an intensification of the flame zone and thus improved flame stability due to an enlargement of the backflow bubble. The size of the radius depends on the flow inside the mixing tube. It is selected in such a way that the flow comes into contact with the wall and thus the swirl coefficient is considerably increased. Compared with a flow without a radius, the backflow bubble is now hugely enlarged, which maximizes the stabilization of the flame front.

A further advantage of the invention can be seen in the fact that the enlargement of the backflow bubble can also be achieved by other measures inside the burner front, preferably by toroidal recesses in the burner front.

Advantageous and expedient further developments of the achievement of the object according to the invention are defined in the further claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

All elements not required for directly understanding the invention have been omitted, and the direction of flow of the media is indicated by arrows.

Figure 1:
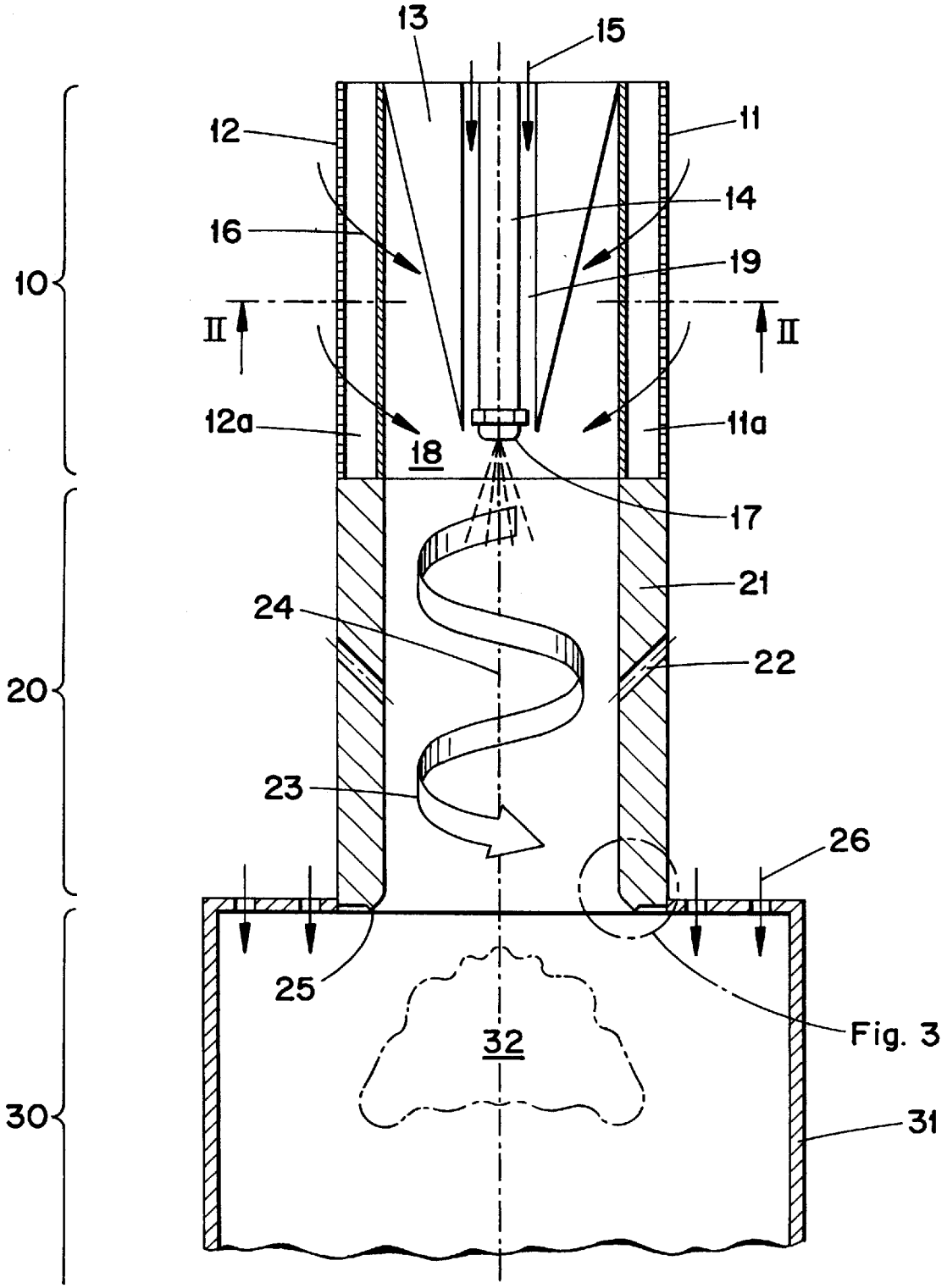
FIG. 1 shows a premix burner consisting of a swirl generator with adjoining mixing tube and combustion chamber.
Figure 2:
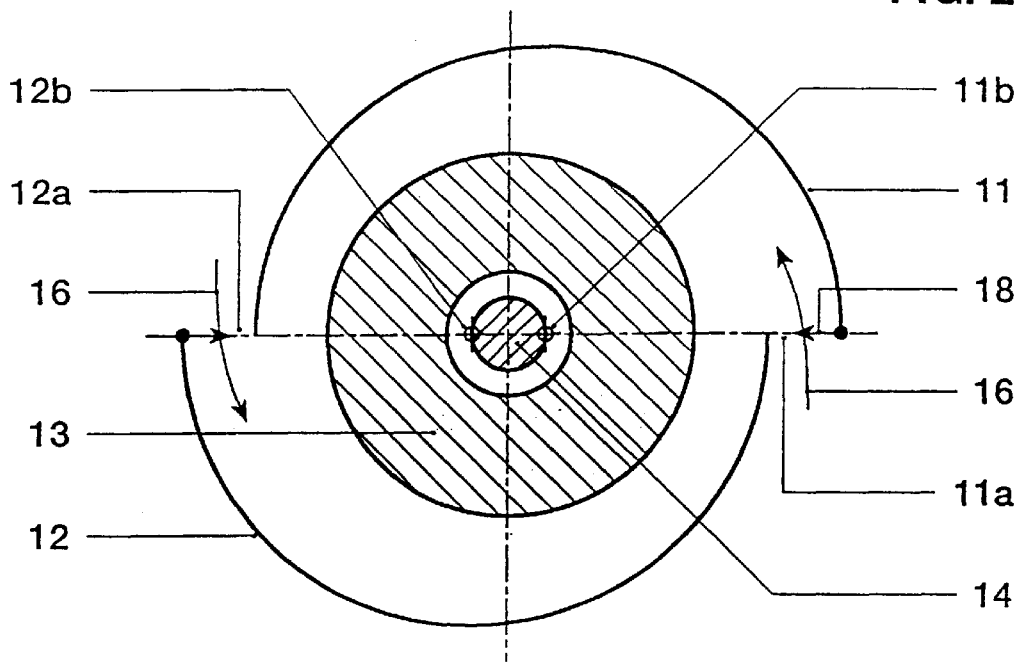
FIG. 2 shows a cross section through the swirl generator along section plane II—II.

In order to better understand the construction of the premix burner, it is of advantage if FIG. 2 is also is used at the same time as FIG. 1. Furthermore, so that FIG. 1 is not made unnecessarily complex, the tangential air-feed ducts have only been shown schematically. In the description of FIG. 1 below, FIG. 2 is referred to when required.

DESCRIPTION OF THE PREFERRED EMBODIMENTS

Referring now to the drawings, wherein like reference numerals designate identical or corresponding parts throughout the several views, the premix burner according to FIG. 1 consists of a swirl generator 10, a mixing section 20 arranged downstream of the swirl generator, and a combustion chamber 30 acting adjacently. The swirl generator 10 consists of two hollow sectional shells 11, 12 which are nested one inside the other in a mutually offset manner (cf. FIG. 2 in this respect). The mutual offset of the respective center axis or longitudinal symmetry axis 11*b*, 12*b* (cf. FIG. 2) provides on both sides, in mirror-image arrangement, one tangential air-inlet duct 11*a*, 12*a* each, through which the combustion air 16 or a fuel/air mixture flows into an interior space 18 formed by the sectional shells 11, 12. The said longitudinal symmetry axes preferably run parallel to one another, whereupon the tangential air-inlet ducts 11*a*, 12*a* have a constant cross section of flow. If required, the cross section of flow may be configured so as to decrease or increase regularly or irregularly in axial direction by a corresponding progression of the longitudinal symmetry axes relative to one another. The shells 11, 12 themselves preferably run cylindrically in the direction of flow. However, they may also assume another geometrical configuration which directly induces the cross section of flow of the interior space 18. For example, the shells 11, 12 may be designed as a venturi tube. The possible embodiments referred to are not shown in more detail graphically, since they can readily be visualized by the person skilled in the art. As far as the number of shells which form the swirl generator 10 are concerned, they are not restricted to two, as follows from the exemplary embodiment. Depending on the operation, a larger number of tangentially arranged air-inlet ducts is readily possible. The individual shells arranged in a mutually offset manner may readily be replaced by a continuous tube, the tube wall of which is provided with tangentially arranged slots which then form the tangential air-inflow ducts. Furthermore, in the case of a multi-shell embodiment, it is possible, if required, to nest the individual shells spirally one inside the other.

Arranged in the interior space 18 is a conical inner body 13 which tapers in the direction of flow and runs out largely in a pointed shape. The conical configuration of this inner body 13, which approximately has the length of the tangential air-inlet ducts, is not restricted to the shape shown: an outer shape of this inner body 13 as a diffuser or confuser is also possible. The determining factor for the configuration of this inner body 13 in interdependence with the tangentially inflowing combustion air 16 is the attainment of a certain swirl coefficient at the outlet of the swirl generator. The inner body 13 has a central bore 19 through which a fuel lance 14 is passed, which in turn extends roughly up to the tip of the inner body. A liquid fuel is preferably fed through this fuel lance 14 and is injected into the interior space 18 via a fuel nozzle 17, which produces a fuel spray angle appropriate for the operation. This fuel nozzle 17 therefore forms the actual head stage of the premix burner. The fuel lance 14 is surrounded with assisting air 15, which initiates at least one axial impulse for stabilizing the flame front 30 forming in the combustion chamber 30. Furthermore, this assisting air 15 helps to increase the optimization of the premixing process, in particular the local stabilization of the flame front, in which case this assisting air may also be enriched by a partial quantity of a recycled exhaust gas. In addition, this assisting air may be replaced by another air/fuel mixture. So that a backflow bubble cannot form at the end of the swirl generator 10, it is important that the swirl forming due to the tangential flow remains subcritical. This can be achieved by various measures, one of which relates to the cross section of flow of the tangential air-inlet ducts 11*a*, 12*a*, and another is directed toward the number of these ducts, the conical profile of the inner body 13 being a factor which is interdependent with the said measures.

Accordingly, the swirl flow 23 consisting of an air/fuel mixture flows into a mixing section 20 without forming a backflow zone, which mixing section 20 is attached on the downstream side of the swirl generator 10 and essentially comprises a mixing tube 21. This mixing tube 21 fulfills the condition that a defined mixture be provided downstream of the swirl generator 10, in which mixture perfect premixing of fuels of the most varied type is achieved. Furthermore, the mixing tube 21, i.e. its length, enables the flow to be directed free of losses, this mixing tube 21 having a pronounced maximum of the axial velocity profile on the axis 24 so that a flashback of the flame from the combustion chamber 30 is not possible. However, it must not be denied that the axial velocity decreases toward the wall of the mixing tube 21 in such a configuration. In order to also prevent flashback in this region, the mixing tube 21 is provided in the direction of flow and in the peripheral direction with a number of regularly or irregularly distributed throughflow openings 22 which are designed to vary in cross section and direction of flow. An air quantity flows into the interior of the mixing tube through these throughflow openings 22, and an increase in the axial velocity prevailing there is induced along the inner wall for the purposes of a prefilmer, and the mixture is made leaner in this region. Another configuration for achieving the same effect is to provide the cross section of the mixing tube 21 with a convergence, as a result of which the entire velocity level inside this flow section is raised. In the figure, the throughflow openings 22 are designed as bores which run at an acute angle relative to the burner axis 24. If one of the measures selected for directing the swirl flow 23 along the mixing tube 21 produces an intolerable pressure loss, this may be remedied by a diffuser (not shown in the figure) being provided at the end of the mixing tube 21.

The combustion chamber 30, which is schematically indicated by a flame tube 31, adjoins the end of the mixing tube 21, the transition between the two cross sections of flow being characterized by a jump in cross section. Furthermore, this transition is formed by a front wall 25, which is arranged with the end face toward the combustion space and has a number of openings through which an air quantity flows directly into the marginal zones of the jump in cross section. Only in the plane of the jump in cross section does a central backflow zone 32 form, which exhibits the features of a bodiless flame retention baffle. If a fluidic marginal zone forms inside the jump in cross section during the operation, in which marginal zone vortex separations arise due to the vacuum prevailing there, this leads to intensified ring stabilization of the backflow zone 32. Further intensification of the same is achieved by the injection of the air 26 introduced via the burner front. Finally, further intensification of the backflow zone 32 can be achieved by a so-called breakaway edge (cf. FIG. 3) or toroidal recesses being provided in the burner front wall on the combustion-chamber side.

A vortex breakdown, which induces the backflow zone 32, forms in the region of the jump in cross section on account of the subcritical swirl flow arising there. The ignition is effected at the tip of this backflow zone 32: only at this point can a stable flame front develop. The risk of a flashback of the flame into the mixing tube 21 of the premix burner, as is always potentially the case in the premix sections which have been disclosed, against which a remedy is attempted with complicated physical flame retention baffles, need not be feared here for the said reasons. If the combustion air 16 is preheated or enriched with one of the media referred to, preferably with recycled exhaust gas, this assists the vaporization of the liquid fuel injected through the head stage.

FIG. 2 shows, in schematic representation, the configuration of the sectional shells 11, 12 nested one inside the other. Of course, these sectional shells can also be displaced relative to one another beyond this plane, i.e. it is readily possible to overlap the same in the region of the tangential air-inlet slots 11*a*, 12*a*. Furthermore, it is also possible to nest the sectional shells 11, 12 spirally one inside the other by a contra-rotating movement. The shape and size of the tangential air-inlet slots 11*a*, 12*a* can therefore be varied in such a way that the swirl coefficient and the swirl intensity from the swirl generator 10 can be adapted to the respective conditions. The tangential air-inlet slots 11*a*, 12*a* in each case form the outlet opening of a feed duct (not shown in more detail). Further fuel nozzles through which preferably a gaseous fuel 16 is injected are provided in the region of the tangential air-inlet ducts. The configuration of this fuel injection can be seen from EP-0 321 809 B1, this printed publication being adopted as an integral part of this description.

Figure 3:
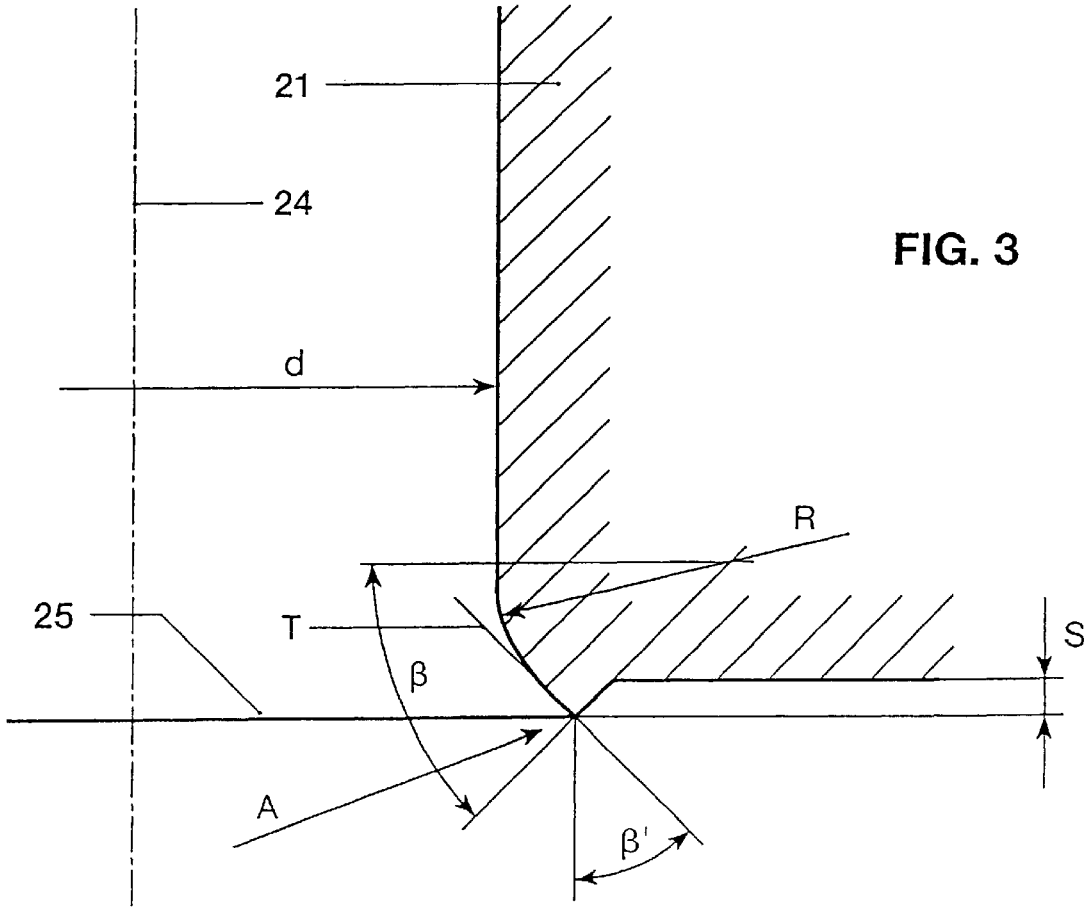
FIG. 3 shows a configuration of the front wall toward the combustion space.

FIG. 3 shows the breakaway edge A already discussed, which is formed in the front wall 25. A transition radius R passing over into the front wall 25 is provided at the end of the cross-section of flow of the mixing tube 21, the size of which transition radius R in principle depends on the flow inside the mixing tube 21. This radius R is selected in such a way that the flow comes into contact with the wall and thus causes the swirl coefficient to increase considerably. Quantitatively, the size of the radius R can be defined in such a way that it is >10% of the throughflow diameter d of the mixing tube 21. Compared with a flow without a radius, the backflow zone is now hugely enlarged. This radius runs up to the outlet plane of the mixing tube 21, the arc angle β between the start and end of the curvature being <90°. The breakaway edge A runs along one leg of the arc angle β into the interior of the mixing tube 21 and thus forms a breakaway step S relative to the front point of the breakaway edge A, the depth of which is >3 mm. Of course, the edge running parallel here to the outlet plane of the mixing tube 21 can be brought to the outlet-plane step again by means of a curved path. The angle β', which extends between the tangent of the breakaway edge A and the perpendicular to the outlet plane of the mixing tube 21, is the same size as the angle β. The advantages of this configuration in the front wall 25 have already been dealt with above in detail under the section "SUMMARY OF THE INVENTION". A breakaway edge for consolidating the backflow zone can also be achieved by concave-like recesses in the front wall on the combustion-chamber side.

Obviously, numerous modifications and variations of the present invention are possible in light of the above teachings. It is therefore to be understood that, within the scope of the appended claims, the invention may be practiced otherwise than as specifically described herein.

What is claimed is:

1. A premix burner comprising:

a swirl generator including a casing with a longitudinal axis extending between an upstream end and a downstream end, said casing including an interior space;

means for injecting a fuel into said interior space;

conical inner body extending longitudinally in said interior space;

at least one tangential air-inlet duct formed in said casing and extending longitudinally for conducting combustion air into said interior space through said tangential air-inlet duct;

a mixing tube downstream of said swirl generator casing, said mixing tube having a downstream end having a cross sectional dimension and an outlet plane;

a combustor having a combustion space positioned downstream of said mixing tube, said combustion space having an upstream end cross sectional dimension;

a front wall forming a jump in cross section between said mixing tube downstream end cross sectional dimension and said combustion space upstream end cross sectional dimension;

said mixing tube merging into said combustor at said jump in cross section, and wherein a backflow zone can form in the region of a plane of said jump in cross section when combustion air and fuel flows through said burner; and wherein said front wall comprises a separation edge at said mixing tube downstream end, said separation edge including a transition radius at said mixing tube outlet plane and a separation step radially offset from said mixing tube outlet plane.

2. The premix burner as claimed in claim 1, wherein said conical inner body includes a tip and said fuel injecting means comprises at least one fuel lance having a fuel nozzle extending through said conical inner body, said fuel nozzle being arranged adjacent to said tip of said conical inner body.

3. The premix burner as claimed in claim 2, wherein said fuel lance is arranged centrally in said conical inner body.

4. The premix burner as claimed in claim 2, wherein said fuel lance is separated from said conical inner body by a space for an air flow.

5. The premix burner as claimed in claim 1, wherein said conical inner body has the shape of a diffuser.

6. The premix burner as claimed in claim 1, wherein said inner body has the shape of a confuser.

7. The premix burner as claimed in claim 1, wherein said swirl generator casing is at least quasi-cylindrical.

8. The premix burner as claimed in claim 1, wherein the cross section of flow formed by said swirl generator casing has the shape of a venturi.

9. The premix burner as claimed in claim 1, wherein said swirl generator casing comprises at least two sectional shells nested one inside the other in a mutually offset manner, and wherein said sectional shells include adjacent walls which form air-inlet ducts, tangential in their longitudinal extent, for the throughflow of combustion air.

10. The premix burner as claimed in claim 9, wherein said sectional shells are spirally nested one inside the other.

11. The premix burner as claimed in claim 9, further comprising additional fuel nozzles arranged adjacent to and longitudinally along said tangential air-inlet ducts.

12. The premix burner as claimed in claim 1, wherein said mixing tube further comprises a sidewall, an interior, and throughflow openings extending through said mixing tube sidewall for injecting an air flow into said mixing tube interior.

13. The premix burner as claimed in claim 12, wherein said mixing tube throughflow openings extend through said mixing tube sidewall at an acute angle relative to said longitudinal axis.

14. The premix burner as claimed in claim 1, wherein said mixing tube comprises a sidewall defining a mixing tube inside diameter, said transition radius is greater than 10% of said inside diameter of said mixing tube, and wherein said separation edge has a depth greater than 3 mm.

* * * * *